US005975501A

United States Patent [19]

Berg et al.

[11] Patent Number: 5,975,501

[45] **Date of Patent: *Nov. 2, 1999**

[54] FENCE STRAND RETAINER CLIP FOR FENCE POSTS

[75] Inventors: Jon A. Berg; Ronald H. Langlie; David F. Buelow, all of Ellendale, Minn.

[73] Assignee: North Central Plastics, Ellendale, Minn.

[ * ] Notice: This patent is subject to a terminal disclaimer.

[21] Appl. No.: 08/925,576

[22] Filed: Sep. 8, 1997

[51] Int. Cl.[6] ..... E04H 17/10

[52] U.S. Cl. ..... 256/48; 256/10; 256/54; 256/DIG. 3; 174/158 F

[58] Field of Search ..... 256/10, 32, 47, 256/48, 50, 51, 54, 19, DIG. 3; 174/163 F, 161 F, 158 F

[56] References Cited

U.S. PATENT DOCUMENTS

| | | | |
|---|---|---|---|
| D. 204,763 | 5/1966 | Fulbright . | |
| 229,385 | 6/1880 | Cunningham . | |
| D. 243,614 | 3/1977 | Russo . | |
| 294,493 | 3/1884 | Miner . | |
| 390,951 | 10/1888 | Dow . | |
| 1,517,119 | 11/1924 | Luhring . | |
| 2,821,365 | 1/1958 | Lach . | |
| 2,861,122 | 11/1958 | Flower . | |
| 3,081,848 | 3/1963 | Nordeng . | |
| 3,091,997 | 6/1963 | Byrd . | |
| 3,385,565 | 5/1968 | Cuthbert . | |
| 3,464,671 | 9/1969 | Thomas . | |
| 3,654,383 | 4/1972 | Wilson . | |
| 3,788,336 | 1/1974 | Steffes . | |
| 3,820,758 | 6/1974 | Berg, Jr. et al. | 256/47 X |
| 3,977,653 | 8/1976 | Fingerson et al. . | |
| 4,032,248 | 6/1977 | Parduhn et al. . | |
| 4,046,356 | 9/1977 | Rose . | |
| 4,070,007 | 1/1978 | Minor et al. . | |
| 4,077,611 | 3/1978 | Wilson | 256/10 |
| 4,105,350 | 8/1978 | O'Donnell . | |
| 4,185,424 | 1/1980 | Streit . | |
| 4,290,712 | 9/1981 | Hayes . | |
| 4,358,090 | 11/1982 | Glaesener . | |
| 4,470,579 | 9/1984 | Aho | 256/10 |
| 4,520,231 | 5/1985 | Hubbell | 256/48 X |
| 4,779,955 | 10/1988 | Schmanski . | |
| 4,866,218 | 9/1989 | Wilson, Jr. | 256/10 X |
| 4,965,413 | 10/1990 | Langlie et al. | 174/158 F |
| 5,032,693 | 7/1991 | Langlie et al. | 174/158 F |
| 5,063,274 | 11/1991 | Johnson | 174/158 F |
| 5,205,236 | 4/1993 | Hughes . | |
| 5,395,093 | 3/1995 | Chrisman . | |
| 5,452,965 | 9/1995 | Hughes, Sr. . | |
| 5,577,710 | 11/1996 | Kirby . | |

OTHER PUBLICATIONS

Information Sheet entitled POSTS, Polycarb QuikPost III, 1997 Premier Sheep Supplies, Ltd.

*Primary Examiner*—Harry C. Kim
*Attorney, Agent, or Firm*—Merchant & Gould P.C.

[57] ABSTRACT

The invention relates to a retainer clip or latch attached to a fence post, such as a plastic fence post, for use in electric fences, that can be used with different types of fence strand members, and that is operated by hand to permit easy securement and removal of the fence strand members. The clip includes first and second portions which are hingedly attached together at one end and are releasably engageable with each other at the opposite end. The clip defines a loop at one end for holding an elongate fence strand member, such as wire, and an elongated area for holding a broader fence strand members, such as electric tape. The loop and elongated area are separated by a finger which extends from the second portion and into a notch in the first portion. The clips can be directly attached to a head portion of a T-shaped fence post at spaced locations along its length. In other embodiments, the clip is attached to an elongate bar which is detachably secured to the head portion of the fence post, or the clip is attached to an end cap which is detachably secured to an end of the fence post.

17 Claims, 6 Drawing Sheets

FENCE STRAND RETAINER CLIP FOR FENCE POSTS

FIELD OF THE INVENTION

The present invention relates to a retainer clip or latch that is attached to a fence post for securing fence strand members to the fence post, particularly for use in electric fencing systems.

BACKGROUND OF THE INVENTION

A fence is generally constructed of a plurality of spaced, vertically extending fence posts with fence strand members, such as electric wire or tape, barbed wire, etc. extending between the fence posts at spaced vertical locations along the fence posts. The fence strands are typically secured to each fence post in order to secure the fence strands in place and maintain the vertical spacing thereof. Previous systems for securing fence strand members to fence posts include forming holes or slots in the fence posts to receive the fence strands, as shown in U.S. Pat. No. 2,861,122; providing tabs or projections on the fence posts for securing the fence strands, as shown in U.S. Pat. Nos. 2,821,365 and 4,070,007; and by using retainer members which are secured around the fence post and fence strands for securing the fence strands in place, such as shown in U.S. Pat. No. 3,977,653. These previous securement systems however are generally designed for use with a single type of fence strand member and thus do not allow for a wide range of fencing materials to be secured to the fence post. Additionally, many of the previous securement systems are difficult to use, often times requiring a physical deformation of the securement structure, in order to both secure the fence strands in place and to permit removal of the fence strands, thus usually requiring the use of a deformation tool.

What is needed then is a system for securing fence strand members to a fence post that can be used with a wide variety of fence strand members, and that does not require a physical deformation of a securement member in order to secure the fence strands in place.

SUMMARY OF THE INVENTION

Therefore the general purpose of the present invention is to provide a retainer clip or latch attached to a fence post, such as a plastic fence post, for use in electric fences, that can be used with different types of fence strand members, and that is operated by hand to permit easy securement and removal of the fence strand members.

A preferred embodiment of the retainer clip in accordance with the principles of the present invention includes a first portion attached to a support base member of the fence post and a second, moveable portion hingedly attached at a first end thereof to a first end of the first portion and disposed over the first portion. The first and second portions are made of a non-conducting material, such as plastic. The first ends are preferably integrally attached to each other, thus forming a film hinge at the first ends. The second portion includes a second end that is in selective engagement with a second end of the first portion, whereby when the second ends are engaged, a generally circular loop and an elongated, rectangular shaped area are defined between the portions. The loop is located adjacent the first ends for holding a slender strand member, such as wire or rope. The elongated area is located between the loop and the second ends for holding a relatively wide strand member, such as tape, therein. The second, moveable portion includes a finger extending therefrom toward the first portion, and the first portion includes a notch that receives the finger when the second ends are engaged. The finger separates the loop from the elongated area, to prevent movement of the strand member from its respective area. In addition, the first portion includes a tapered locking shoulder at the second end thereof, and the second portion includes a tapered locking tab at the second end thereof, so as to form a selectively releasable connection between the first portion and the second portion. A finger actuated tab is connected to the tapered locking tab for releasing the connection between the locking tab and the locking shoulder. The clip can be attached to various portions of the fence post, such as the head portion of a T-shaped fence post, an elongate bar which spaces the clip from the post, or an end cap secured to an end of the fence post.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE DRAWINGS

Figure 2:
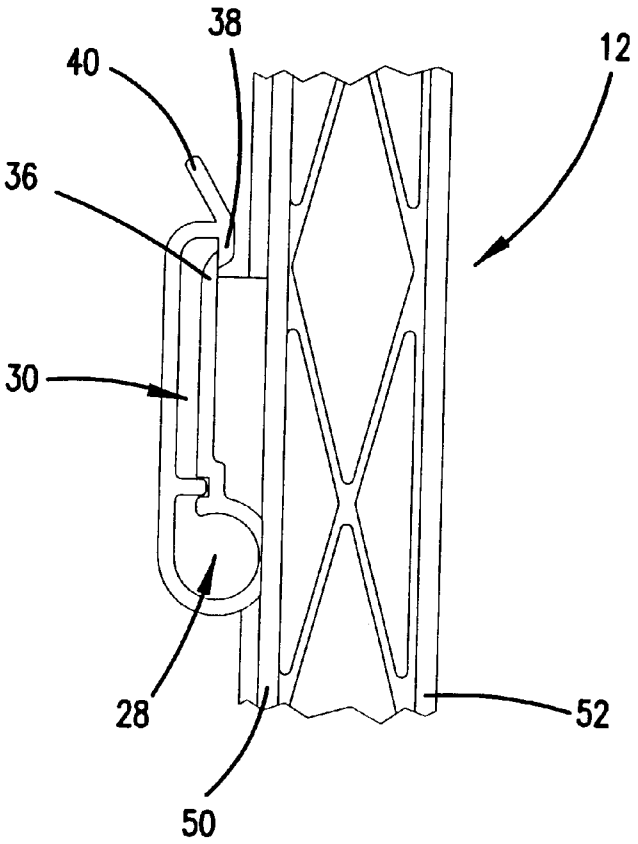
FIG. 2 is a view similar to FIG. 1, but with the clip in a closed position.
Figure 1:
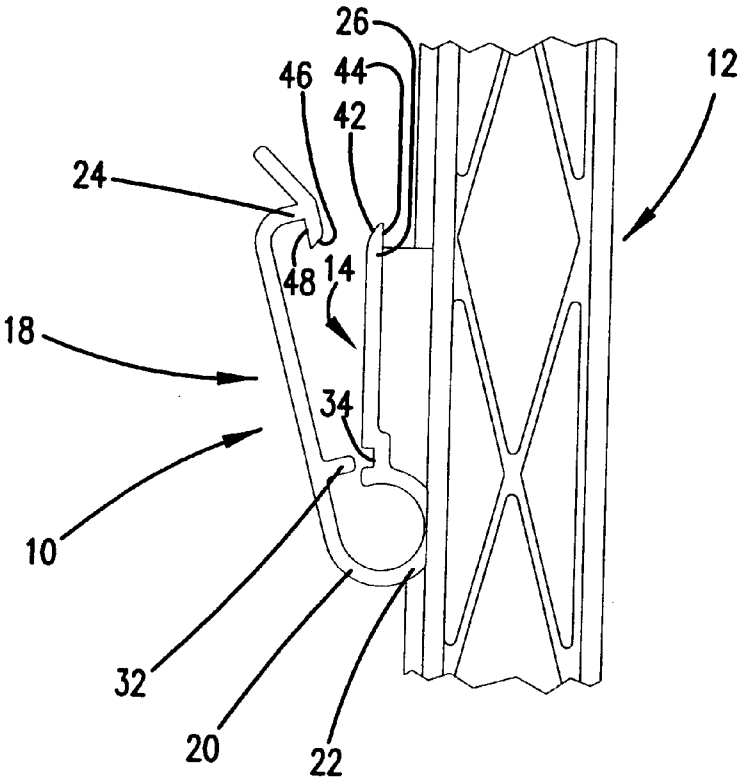
FIG. 1 is a side view of a retainer clip attached to a fence post, with the clip in an open position.
Figure 3:
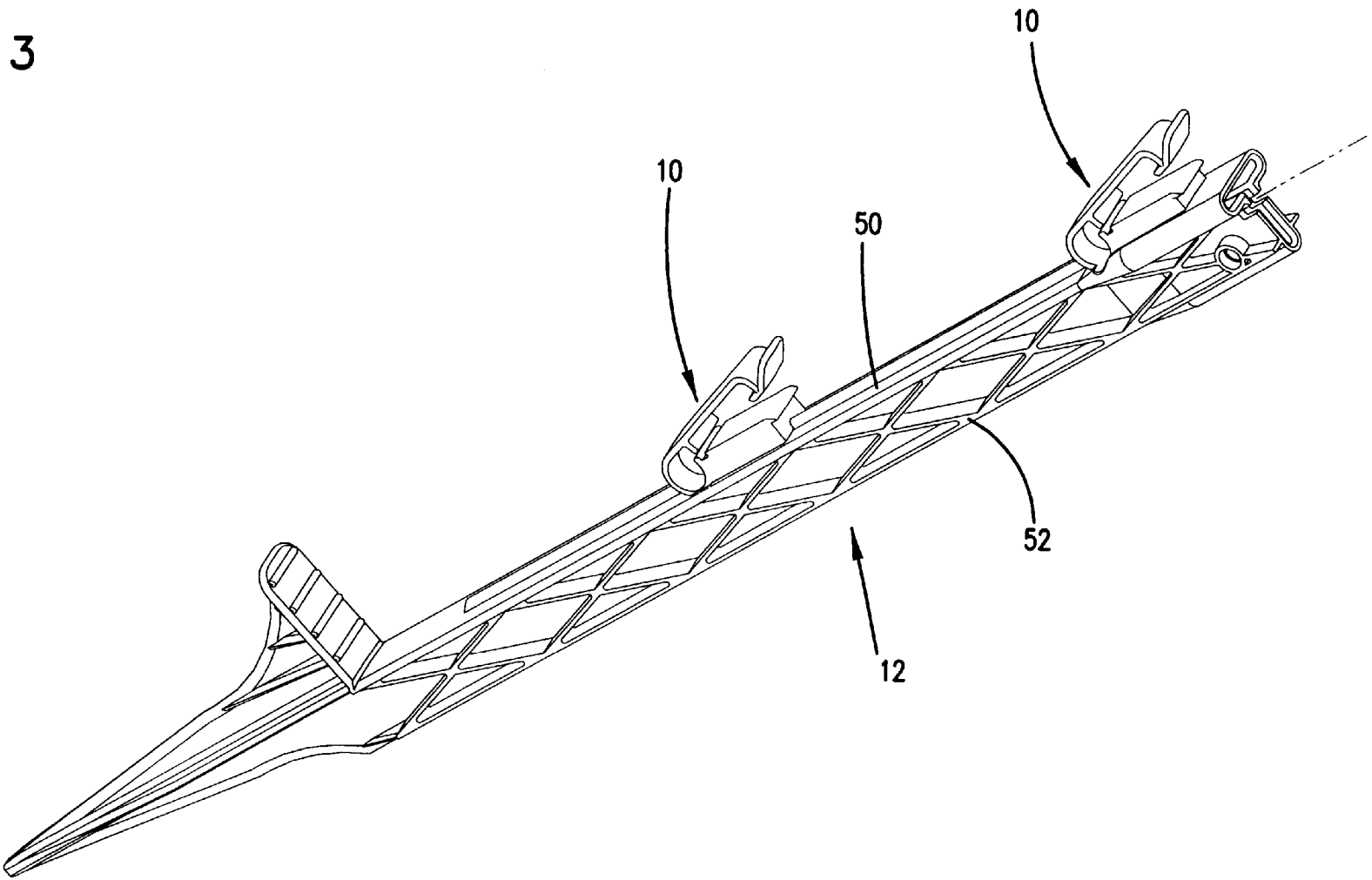
FIG. 3 is a perspective view of the fence post showing a plurality clips spaced along the post.

As shown in FIGS. 1–3, retainer clips 10 are attached to a fence post 12 in order to secure fence strand members to the fence post. The fence post 12 can be made of a plastic, wood, or other non-conducting material, for use in an electric fence system. The clips 10 are also made of a non-conductive material, such as plastic, so that the clips are able to support electric fence strand members without conducting electricity.

As shown in FIGS. 1–2, each retainer clip 10 includes a first portion 14 attached to a portion of the fence post and a second, moveable portion 18 generally doubled back over the first portion. The second portion 18 includes a first end 20 which is resiliently connected to a first end 22 of the first portion 14 so as to form a hinged connection therebetween. The connection between the first ends 20,22 generally forms a film hinge, which permits the second portion to pivot relative to the first portion. The second portion 18 further includes a second end 24 which can be selectively engaged with a second end 26 of the first portion 14. Each portion 14,18 is made of a non-conducting material, such as plastic or a suitable composite, in order to support electric fence strand members without conducting electricity.

As best seen in FIG. 2, when the second ends 24,26 are engaged, a generally circular loop 28 is defined adjacent the first ends 20,22 of the clip for holding and retaining a slender fence strand member, such as electric wire, barbed wire, or rope. A generally rectangular, elongated area 30 is also formed between the overlapping portions 14,18 for holding a broader fence strand member, such as electric tape, therein.

The portion 18 includes a finger 32 extending therefrom toward the portion 14, and the portion 14 includes a notch 34 therein that receives the finger when the second portion is engaged with the first portion, as is seen in FIG. 2. The finger is located between the loop 28 and the elongated area 30 in order to prevent a slender strand member within the loop from moving up into the elongated area, and vice-versa.

As stated previously, the two portions 14,18 are selectively releasably engaged with each other to secure the strand member(s) within the clips 10 by connecting the second ends 24,26 together. The portion 14 includes a tapered locking shoulder 36 at the second end 26, while the second portion 18 includes a tapered locking tab 38 at the second end 24 thereof. The tapered locking tab 38 and the tapered locking shoulder 36 form a selectively releasable connection between the first portion and the second portion, with a finger release tab 40 connected to the tapered locking tab 38 for releasing the connection between the locking tab and the locking shoulder. The tab 40 can be moved backward using a thumb or finger from the position shown in FIG. 2, so as to release engagement between the tab and shoulder, and permit the second portion to be pivoted to the position shown in FIG. 1. The tapered locking shoulder 36 includes an angled side 42 and a straight side 44, while the tapered locking tab 38 includes an angled side 46 and a straight side 48. The angled sides 42,46 on the tab and shoulder permit the second portion to be moved to the locked position shown in FIG. 2 by sliding over each other, with the straight sides facing each other once in the locked position in order to retain the clip in the locked position until the tab 40 is actuated to release the connection.

The clips can retain a single fence strand member in either of the loop or elongated area, or a fence strand member can be secured in each one of the loop and elongated area. Once the fence strand member is properly located within the clip, the second portion is pivoted toward the first portion, and the seconds ends thereof are secured together to retain the strand members in place. To remove a fence strand, or to add a strand, the user simply actuates the release tab 40 backwards, thus pivoting the locking tab 38 away from the locking shoulder 36 to permit disengagement of the second ends.

As shown in FIG. 3, the fence post 12 can be generally T-shaped including a head portion 50 and a stem portion 52 extending generally perpendicularly from the head portion. The fence post 12 includes a plurality of the clips 10 at spaced locations therealong in order to vertically space the fence strands. The clips 10 are attached to the head portion 50 of the post 12 by being integrally attached thereto during formation of the post, or by being secured to the post after formation thereof.

Figure 4:
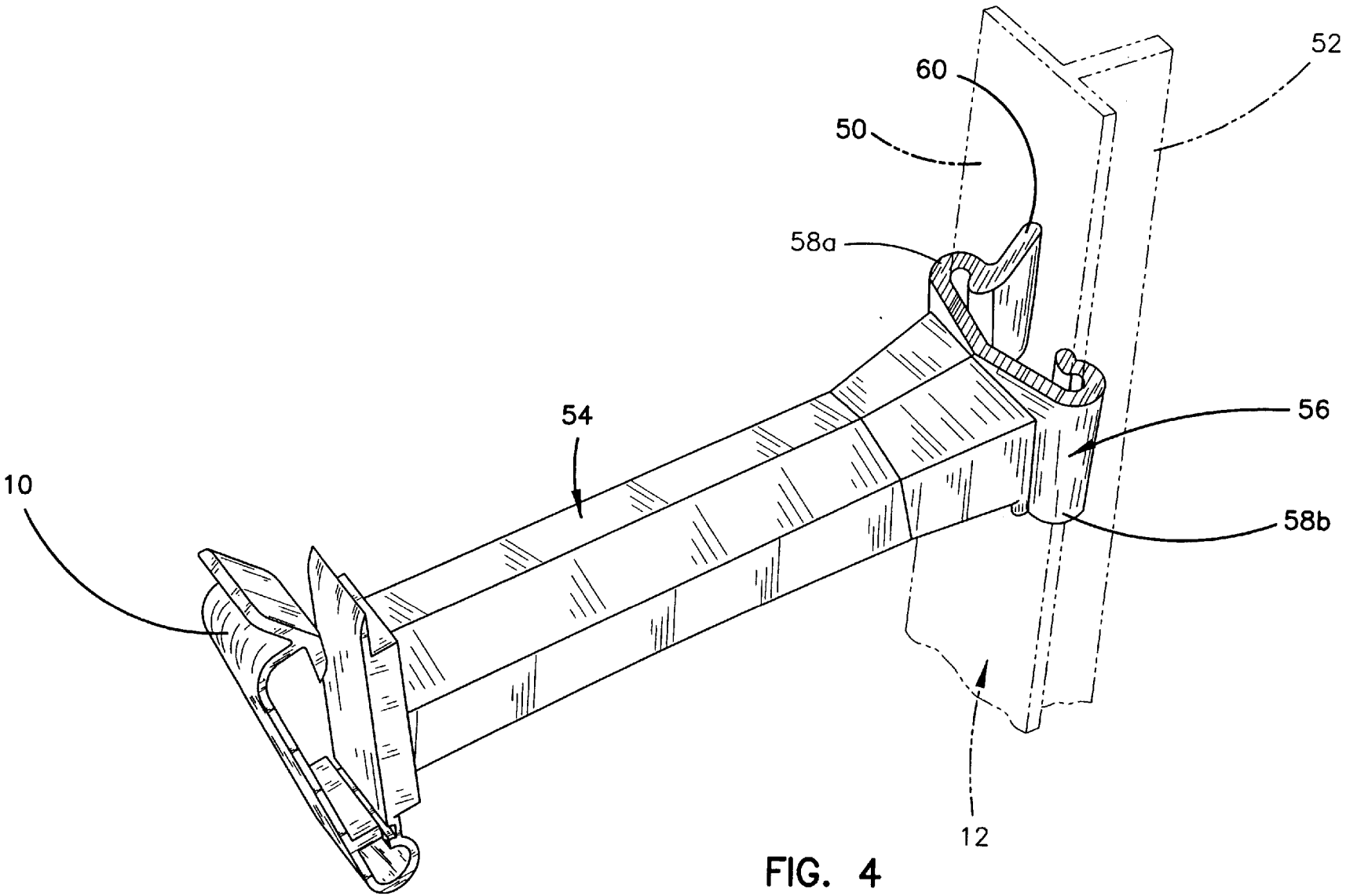
FIG. 4 is a view of the clip attached to a bar which can be secured to a T-shaped fence post.

FIG. 4 shows an embodiment where the clip 10 is secured to the end of an elongated bar 54 for spacing the clip a desired distance away from the main portion of the T-shaped fence post 12. The bar 54 is also made of a non-conductive material, such as plastic, and includes a fastener 56 at its end opposite the clip 10 for detachably securing the bar 54 to the head portion 50 of the post 12. As shown, the fastener 56 includes a pair of hooks 58*a,b* at each end which hook around the head portion, with a release tab 60 connected to the hook 58*a* for facilitating release of the connection between the fastener and the head portion. A plurality of the clip and bar assemblies can be secured along the length of the post 12, in addition to, or in place of, the clips attached to the post, for securing the fence strands to the post.

Figure 5:
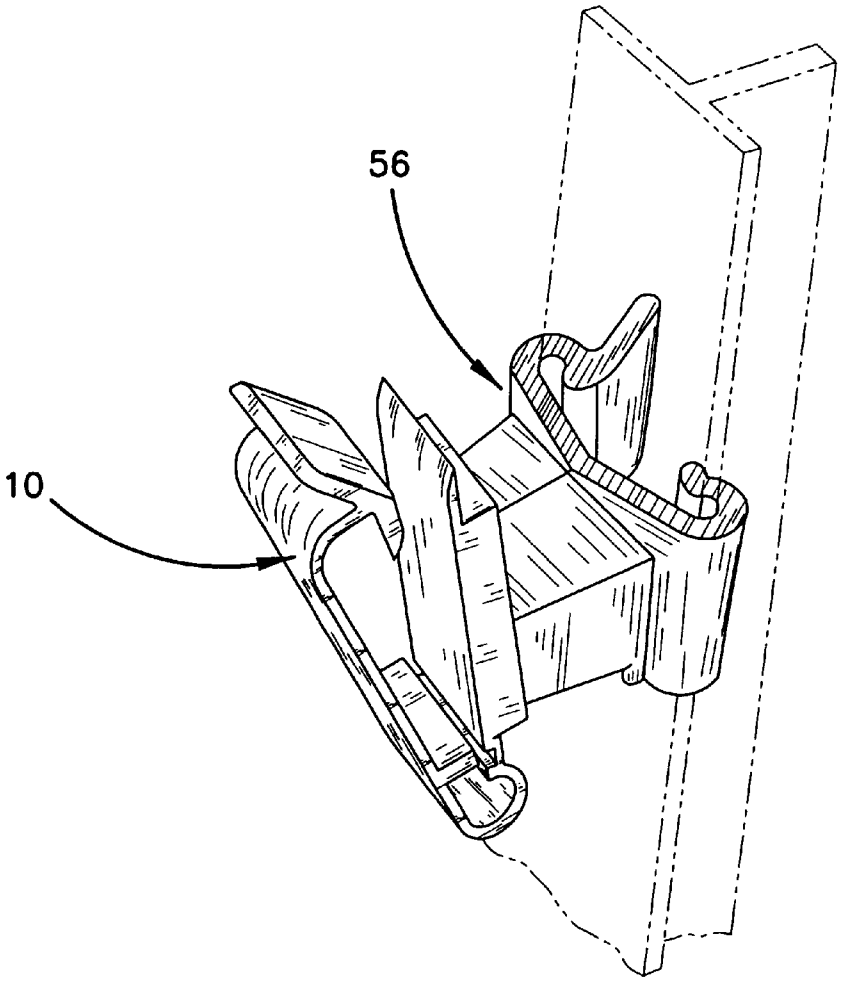
FIG. 5 is a view of the clip with a detachable securement to a T-shaped fence post.

FIG. 5 shows an embodiment similar to FIG. 4, but in this embodiment, the bar 54 is eliminated so that the clip 10 is attached directly to the fastener 56. This embodiment thus provides a detachable securement of the clip to the fence post, without the clip being spaced a large distance from the post. The construction and operation of this embodiment is otherwise similar to FIG. 4.

Figure 6:
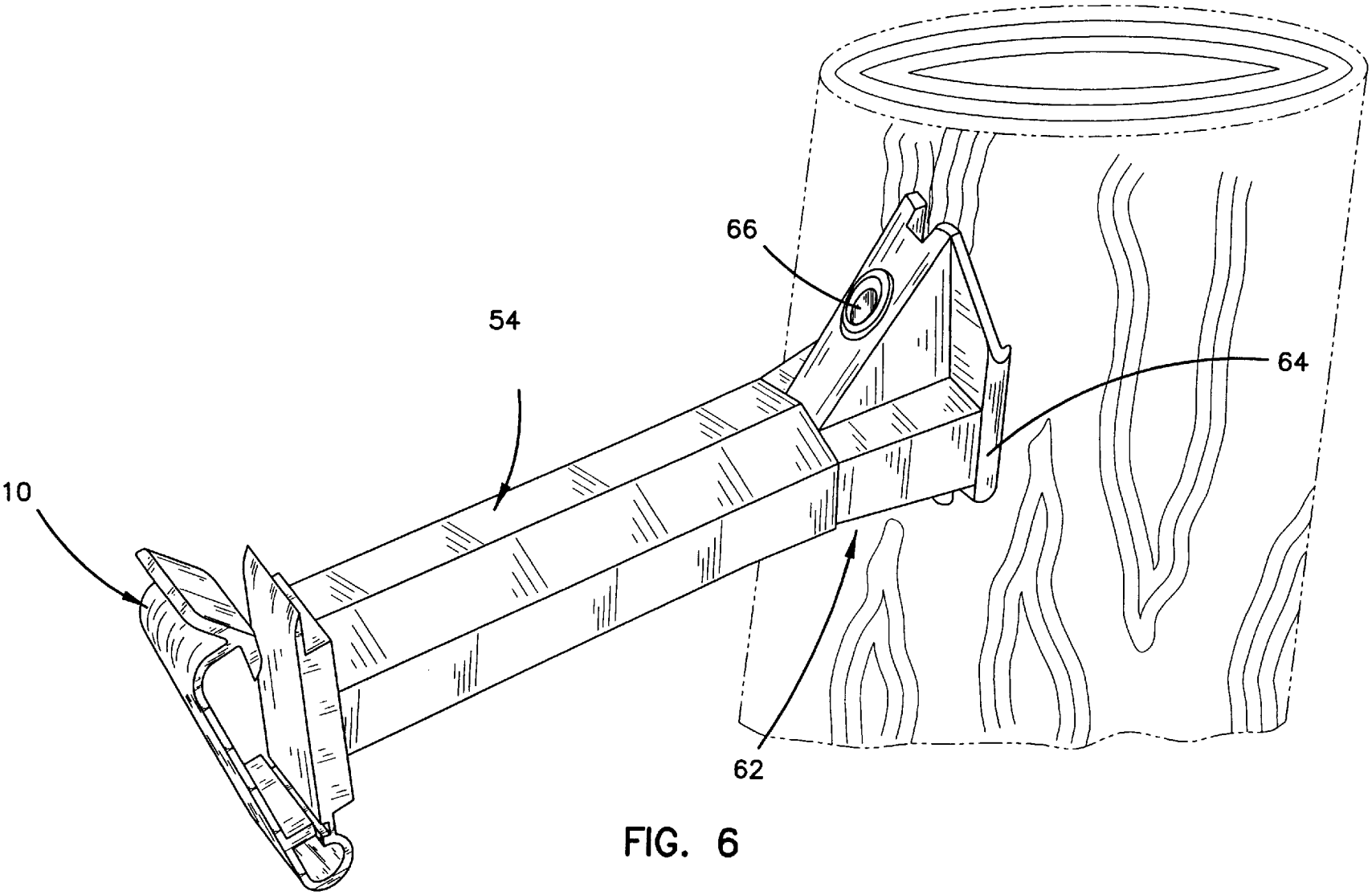
FIG. 6 is a view of the clip attached to an alternate bar for detachable securement to wooden fence post.

FIG. 6 illustrates another embodiment where the clip 10 is spaced from a wooden fence post using the non-conducting, elongate bar 54. However, the bar 54 is secured to the post using a different fastener 62. The fastener 62 includes small shoulders 64 at each side thereof (only one shoulder being visible in FIG. 6) which dig into the material of the post to help secure the fastener in place. A hole 66 is provided through the body of the fastener 62 at an angle to the longitudinal axis of the bar 54 to permit passage of a mechanical fastener, such as a nail, screw or bolt (not shown), for securing the fastener to the wood fence post.

Figure 7:
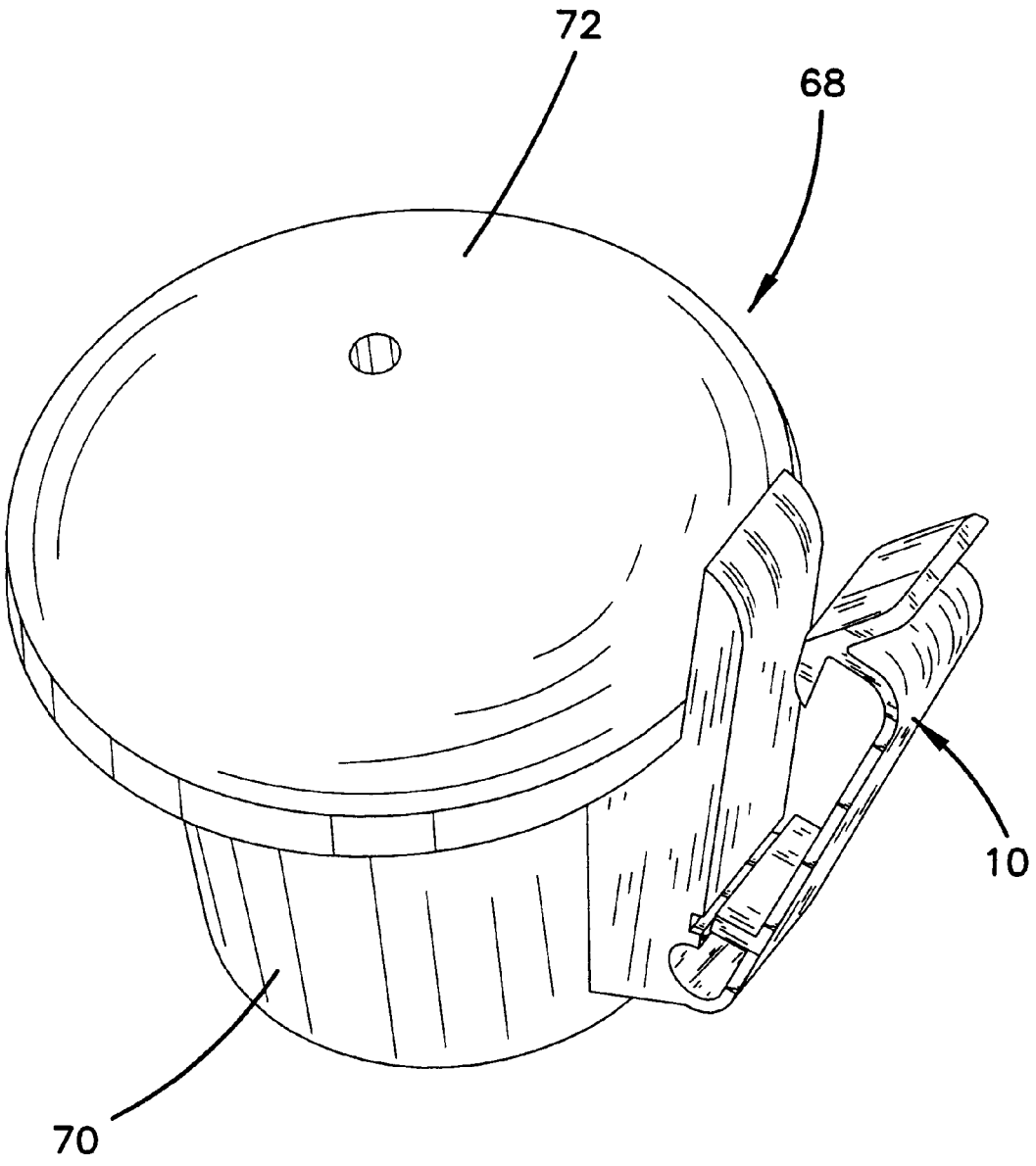
FIG. 7 is a view of the clip attached to an end cap of the fence post.

FIG. 7 illustrates a further embodiment in which the clip 10 is attached to one side of an end cap 68 that can be detachably secured onto an end of either the T-shaped or wood fence post. The end cap is made from a non-conducting material and includes a cylindrical base 70 that is provided with a suitably shaped aperture to receive the end of the fence post, and a rounded top 72. Again, this embodiment can be used to provide a clip in place of, or in addition to, the previously described clips.

While certain embodiments of the invention have been described as being used on a fence post which is T-shaped, other fence post shapes could be used. Further, the embodiment shown in FIG. 6 could be used on fence posts other than wood. The fastener 56 and the end cap 68 would be appropriately altered to permit use with a different fence post shape.

It is to be understood that while certain embodiments of the present invention have been illustrated and described, the invention is not limited to the specific forms or arrangements of parts described and shown.

What is claimed is:

1. A retainer clip used on a fence post, the combination comprising:

a first portion fixedly attached to a part of the fence post;

a second, moveable portion hingedly attached at a first end thereof to a first end of the first portion, said second portion being disposed over said first portion and having a second end thereof in selective engagement with a second end of the first portion, wherein a loop and an elongated area are defined between the first and second portions when said second end of the second portion is engaged with said second end of the first portion, said first portion and said second portion being made from a non-conducting material; and a finger located at a position between said loop and said elongated area and separating said loop from said elongated area.

2. The retainer clip and fence post according to claim 1, wherein said non-conducting material comprises plastic.

3. The retainer clip and fence post according to claim 1, wherein the loop is located adjacent the first ends of the first and second portions.

4. The retainer clip and fence post according to claim 3, wherein the elongated area is located between the loop and the second ends of the first and second portions.

5. The retainer clip and fence post according to claim 4, wherein the finger extends from said second portion toward the first portion, and said first portion includes a notch therein that receives said finger when the second ends are engaged.

6. The retainer clip and fence post according to claim 1, wherein the loop is generally circular.

7. The retainer clip and fence post according to claim 1, wherein the elongated area is generally rectangular.

8. The retainer clip and fence post according to claim 1, wherein said first portion includes a tapered locking shoulder at said second end thereof, and said second portion includes a tapered locking tab at said second end thereof, said tapered locking shoulder and said tapered locking tab being engaged with each other in order to connect the second ends together.

9. The retainer clip and fence post according to claim 8, further including a finger actuated tab connected to the tapered locking tab for permitting release of the engagement between the locking shoulder and the locking tab.

10. The retainer clip and fence post according to claim 8, wherein said tapered locking shoulder and said tapered locking tab each include an angled side and a straight side, the angled sides facing each other when the second ends are disengaged and the straight sides facing each other when the second ends are engaged.

11. The retainer clip and fence post according to claim 1, wherein said first ends are integrally connected together.

12. The retainer clip and fence post according to claim 1, wherein said fence post part comprises a vertically extending portion of the fence post.

13. The retainer clip and fence post according to claim 12, wherein the fence post includes a head portion and a stem portion extending perpendicularly from the head portion, said first portion being fixedly attached to said head portion.

14. The retainer clip and fence post according to claim 1, wherein said fence post part comprises an elongate bar extending perpendicularly from the fence post.

15. The retainer clip and fence post according to claim 14, wherein said elongate bar is detachably secured to the fence post.

16. The retainer clip and fence post according to claim 1, wherein said fence post part comprises an end cap secured to an end of the fence post.

17. A retainer clip used on a fence post, the combination comprising:

a first portion fixedly attached to a part of the fence post; and a second, moveable portion hingedly attached at a first end thereof to a first end of the first portion, said second portion being disposed over said first portion and having a second end thereof in selective engagement with a second end of the first portion, wherein a loop and an elongated area are defined between the first and second portions when said second end of the second portion is engaged with said second end of the first portion, said loop and said elongated area being closed off from each other, said first portion and said second portion being made from a non-conducting material, wherein said loop is generally circular.

* * * * *